United States Patent [19]

Jung-Chung

[11] Patent Number: 4,905,611

[45] Date of Patent: Mar. 6, 1990

[54] TABLE WITH EASILY CHANGEABLE TABLE SHEET

[76] Inventor: Peng Jung-Chung, No. 773-10, Chung Shan Rd., Wu-Jih Hsiang, Taichung, Taiwan

[21] Appl. No.: 304,253

[22] Filed: Jan. 31, 1989

[51] Int. Cl.[4] ..... A47B 3/06

[52] U.S. Cl. ..... 108/157; 108/153

[58] Field of Search ..... 108/157, 153, 154, 136, 108/27, 37, 90, 96; 211/59.3; 221/45, 50, 59

[56] References Cited

U.S. PATENT DOCUMENTS

| | | | |
|---|---|---|---|
| 1,916,435 | 7/1933 | Ott et al. | 108/157 |
| 2,863,675 | 12/1958 | Otto | 221/45 |
| 3,291,339 | 12/1966 | Hein | 221/45 |
| 4,627,363 | 12/1986 | Jones | 108/90 |
| 4,821,651 | 4/1989 | Peng | 108/157 |

FOREIGN PATENT DOCUMENTS

| | | | |
|---|---|---|---|
| 1357160 | 2/1964 | France | 211/59.3 |
| 2177065 | 1/1987 | United Kingdom | 221/45 |

*Primary Examiner*—Dorner Kenneth J.
*Assistant Examiner*—José V. Chen
*Attorney, Agent, or Firm*—Browdy & Neimark

[57] ABSTRACT

A table includes a supporting board, a retaining seat receiving and confining the supporting board and including an annular portion having a vertically spaced flange and a connecting annular wall, a plurality of elastic members urging the supporting board agaisnt the upper flange, a table sheet formed by a plurality of separable layers of membranes placed on the supporting board, a leg attached under the retaining seat for supporting therefor, and an operating device connected to the supporting board and the leg for making the table sheet easily changeable.

3 Claims, 3 Drawing Sheets

TABLE WITH EASILY CHANGEABLE TABLE SHEET

CROSS-REFERENCE TO RELATED APPLICATION

The present invention is related to the invention set forth in my copending U.S. Pat. application Ser. No. 058,757 filed on June 5, 1987, now U.S. Pat No. 4,821,651.

BACKGROUND OF THE INVENTION

The present invention relates to a table, and more particularly to one with a changeable table sheet.

In order to overcome the disadvantages encountered by the table according to the prior art, it has been attempted by the Applicant to provide a table with a changeable table sheet, as disclosed in the above-mentioned patent application bearing a serial No. 058,757, which includes a base, edge members merging into one another at respective ends to form a retaining seat and each of which has a vertical first plate and a second plate extending substantially perpendicularly from the upper side of the first plate, a table sheet formed by separable layers of membranes, a supporting board positioned under the table sheet, spring members disposed on the retaining seat and between the supporting board and the base, and legs connected under the base. Through the above combination, the top most membrane, gathering thereon the food remains, can be detached from the table by downwardly urging the table sheet and simultaneously disengaging the top most membrane from the table sheet. It has been found that such table can be criticized in the following respects:

1. In order to downwardly urge the table sheet, enough force must be applied thereto. For some persons, it is difficult for them to apply only using one hand enough force to the table sheet in order that the other hand can disengage the top most membrane from the table sheet.

2. Upon disengaging the top most membrane, the soup spillage on the top most membrane may run through the space between the supporting board and the first vertical plates and thus the retaining seat may become contaminated and will be odoriferous after a period of use.

SUMMARY OF THE INVENTION

It is therefore an object of the present invention to provide a table with an easily and speedily changeable table sheet.

It is further an object of the present invention to provide a table with a changeable table sheet which is free from being contaminated by the soup spillage.

According to the present invention, a table with a changeable table sheet includes a supporting board, a retaining seat receiving and confining the supporting board and including an annular portion having a vertically spaced flange and a connecting annular wall, elastic members urging the supporting board against the upper flange, a table sheet formed by a plurality of separable layers of membranes placed on the supporting board, a leg attached under the retaining seat for supporting therefor, and an operating device connected to the supporting board and the leg for making the table sheet easily changeable.

DETAILED DESCRIPTION OF THE PREFERRED EMBODIMENT

Figure 1:
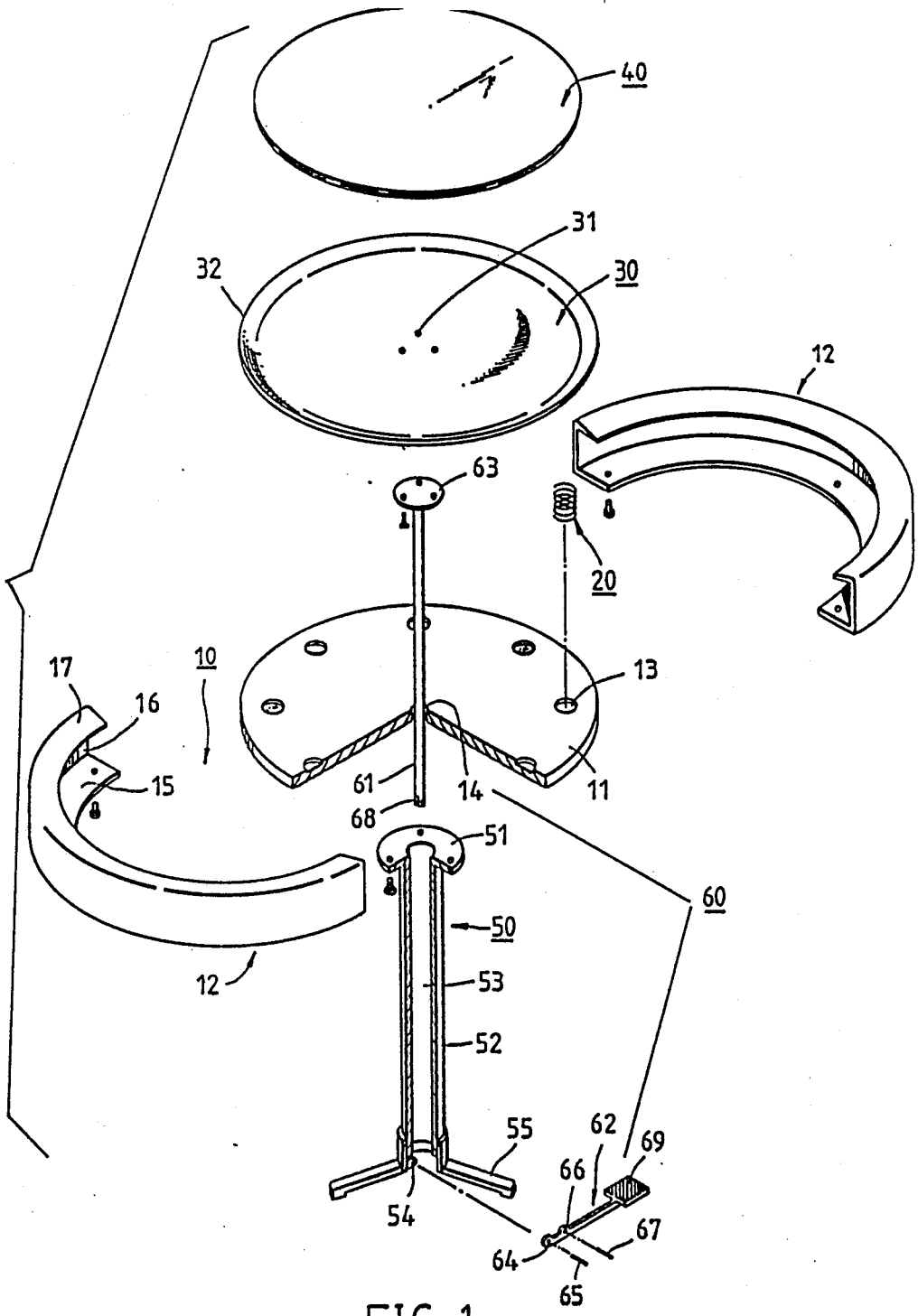
FIG. 1 is an exploded view showing a preferred embodiment of a table with a changeable table sheet according to the present invention.
Figure 2:
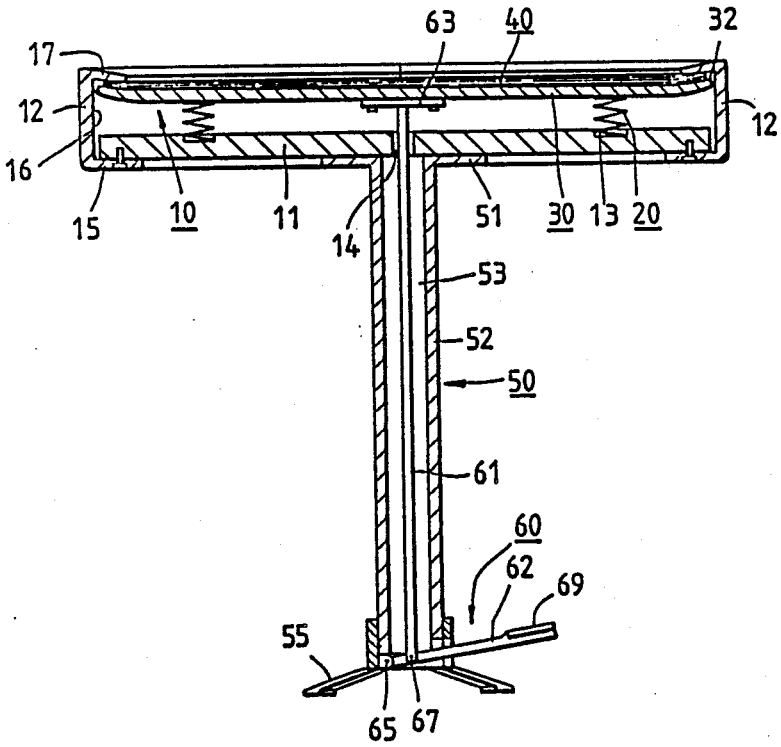
FIG. 2 is a sectional view showing an assembled table in FIG. 1.
Figure 3:
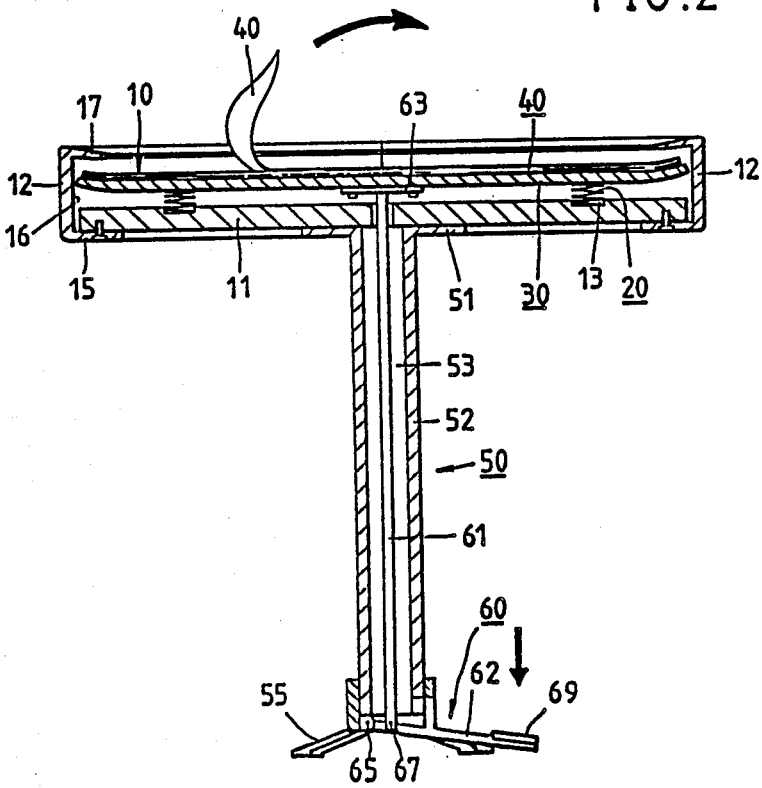
FIG. 3 is a sectional view schematically showing the operation of disengaging the top most membrane from the table in FIG. 1.

Referring now to FIGS. 1–3, a table with a changeable table sheet according to the present invention includes a retaining sheet 10, elastic members 20, a supporting board 30, a table sheet 40, a leg 50, and an operating device 60. Retaining seat 10 includes a base 11 having non-through surrounding holes 13 and a central hole 14, and an annular portion 12 having two vertically spaced inwardly extending radial flanges 15, 17 and a vertical annular wall 16 connecting flanges 15, 17 in the manner that base 11 is secured against the lower flange 15.

Supporting board 30 is axially movably received in annular portion 12 and limited beneath the upper flange 17 and includes central screw holes 31 and an upwardly outwardly extending peripheral flange 32 to retain in supporting board 30 the possible soup spillage. Elastic members 20 being compression springs are respectively received in surrounding holes 13 for urging upwardly supporting board 30 which in turn urges upwardly against upper flange 17 the table sheet 30 which is placed on supporting board 30 and formed by separable layers of soft membranes of e.g., non-woven fabric, paper or plastic film.

Leg 50 includes a positioning plate 51 secured to the undersurface of base 11, a shank portion 52 having a hollow center 53 aligned with central hole 14, a pivoting hole 54 on the bottom end thereof, and a plurality of feet 55 connected to shank portion 52. Operating means 60 includes a first connecting rod 61 which passes through central hole 14 and hollow center 53 and has a top end plate 63 secured to the undersurface of supporting board 30 by screws screwing into holes 31 and a bottom end having a pinhole 68, and a second connecting rod62 which includes an end hole 64 through which a pin 65 passes which a pin 67 passes into pinhole 68 protruded from the bottom end of shank portion 52, and an opposite end actuating pedal 69.

In use, springs 20 enables table sheet 40 to support thereon a substantial weight without failure. When the top most membrane of table sheet 40 gets broken or becomes contaminated, pedal 69 is pedalled downwardly to move downwardly connecting rod 61 which in turn displaces downwardly supporting board 30 downwardly to allow the user to disengage the top most membrane from the present table and to gather together the food remains therein without hastiness (FIG. 3). After pedal 69 is released, the present able gets a fresh top most membrane again (FIG. 2).

Figure 4:
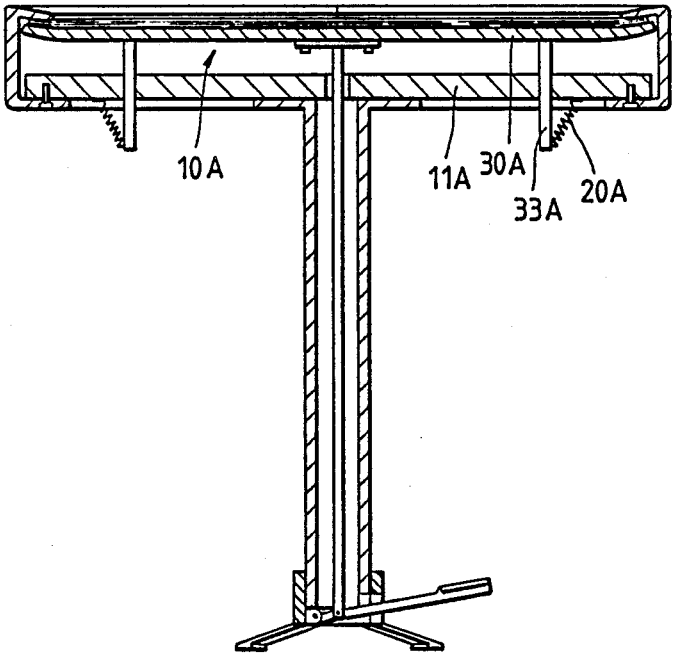
FIG. 4 is a sectional view showing further a preferred embodiment of a table with a changeable table sheet according to the present invention.

As shown in FIG. 4, a second preferred embodiment of a table with a changeable table sheet according to the present invention includes a supporting board 30A securing thereunder a plurality of rod projections 33A passing through the base 11A of the retaining seat 10A, and tension springs 20A respectively having two ends thereof connected to retaining seat 10A and rod projections 33A.

Further modifications can be made to a table with a changeable table sheet according to the present invention. For example, the retaining seat, the supporting board and the table sheet can be rectangularly shaped which is not considered to go beyond the spirit of the present invention.

What I claim is:

1. A table with a changeable table sheet comprising:

a supporting board adapted to be moved between a disengaged position and a engaged position;

a retaining seat having a base and an annular portion connected around a circumferential edge of said base, said annular portion including a vertically spaced inwardly extending radial flange and a vertical annular wall integral with an outer edge of said flange such that said supporting board is received in said retaining seat on said base and is axially movable in said retaining seat with respect to said annular portion but limited beneath said flange;

a plurality of elastic members received in said retaining seat for biasing said supporting board upwardly against said flange;

a table sheet formed by a plurality of separable layers of membranes and placed on said supporting board so as to be urged upwardly against said flange;

a leg attached under said retaining seat for stably supporting thereon said retaining seat;

operating means for making said table sheet easily changeable, said operating means including:

a first connecting rod penetrating through said retaining seat and having a first end fixed to said supporting board and a second opposite end; and a second connecting rod having a third and pivotably connected to said leg, an intermediate portion pivotably connected to said second opposite end and a fourth opposite actuating end, wherein downward actuation of said fourth opposite actuating end causes said supporting board to be lowered into the disengaged position to allow a user to disengage a top membrane of said table sheet from the table and wherein upward release of said fourth opposite actuating end causes said supporting board to move upwardly to abut said table sheet against said flange.

2. A table with a changeable table sheet according to claim 1 wherein:

said base includes a central hole;

said leg includes a bottom end and a hollow center aligned with said central hole;

said first connecting rod passes through said central hole and said hollow center; and said third end is pivotally connected to said bottom end.

3. A table with a changeable table sheet according to claim 2 wherein said supporting board is circular and includes an upwardly outwardly extending peripheral flange.

* * * * *